US010251483B2

(12) United States Patent
Crowley et al.

(10) Patent No.: US 10,251,483 B2
(45) Date of Patent: Apr. 9, 2019

(54) DRAWER SLIDE MOUNTING LOCATOR TOOL AND METHOD OF USE

(71) Applicant: Brian Crowley, La Crosse, WI (US)

(72) Inventors: Brian Crowley, La Crosse, WI (US); Greg Davis, Dallas, TX (US)

(73) Assignee: Brian Crowley, La Crosse, WI (US)

( * ) Notice: Subject to any disclaimer, the term of this patent is extended or adjusted under 35 U.S.C. 154(b) by 198 days.

(21) Appl. No.: 15/171,673

(22) Filed: Jun. 2, 2016

(65) Prior Publication Data

US 2017/0261303 A1 Sep. 14, 2017

Related U.S. Application Data

(60) Provisional application No. 62/307,174, filed on Mar. 11, 2016.

(51) Int. Cl.
*A47B 97/00* (2006.01)

(52) U.S. Cl.
CPC ..... *A47B 97/00* (2013.01); *A47B 2210/00* (2013.01)

(58) Field of Classification Search
CPC ..... A47B 97/00; B25B 11/02; B23P 19/10; Y10T 29/49902
USPC ..... 33/667, 613, 645; 29/428, 464, 468
See application file for complete search history.

(56) References Cited

U.S. PATENT DOCUMENTS 2,203,992 A * 6/1940 Lutz ..... E04F 21/003 33/677
2,821,027 A * 1/1958 Billhimer, Sr. ..... E05B 17/06 33/677
4,257,166 A * 3/1981 Barker et al. ..... B23B 47/287 408/241 G
4,556,205 A * 12/1985 Rock et al. ..... B25B 3/00 269/2
4,952,101 A * 8/1990 Coombs ..... B23B 47/187 408/115 R
6,959,498 B1 * 11/2005 Klonowski, III ..... B23B 47/187 33/194
7,246,449 B2 * 7/2007 Pierson et al. ..... E05B 17/06 33/613
7,281,338 B2 * 10/2007 Ziegmann ..... A47B 88/423 33/645
7,979,998 B2 * 7/2011 Ziegmann ..... A47B 88/00 33/645
8,667,701 B1 * 3/2014 Geesaman ..... A47B 97/00 33/613

(Continued)

*Primary Examiner* — Christopher W Fulton
(74) *Attorney, Agent, or Firm* — Schultz & Associates, P.C.

(57) ABSTRACT

Disclosed is a mounting point locator tool for positioning a bracket of a drawer slide assembly such that the drawer slide assembly is square with the face frame of a cabinet carcass. The locator tool comprises a base perpendicularly extending from a first end of a rod. A bracket holding fixture is connected to a second end of the rod. In one embodiment, the base, the rod, and the fixture are ridgidly connected. In an alternate embodiment, the base is comprised of a sleeve extending generally perpendicular from a planar plate and slidingly engaged with the rod. The sleeve includes a pair of sides connected at a right angle for alignment with the face frame. The fixture includes a pair of prongs having edges spaced a predetermined distance and a set of slots having a predetermined width for releasably securing the bracket.

19 Claims, 11 Drawing Sheets

(56) References Cited

U.S. PATENT DOCUMENTS

| | | | | |
|---|---|---|---|---|
| 2007/0101598 | A1* | 5/2007 | Miro | B23B 47/187 33/667 |
| 2008/0028693 | A1* | 2/2008 | McCauley | E04F 21/00 33/194 |
| 2011/0167604 | A1* | 7/2011 | Stewart et al. | B25B 11/02 29/271 |

* cited by examiner

DRAWER SLIDE MOUNTING LOCATOR TOOL AND METHOD OF USE

CROSS-REFERENCE TO RELATED APPLICATIONS

This application claims the benefit of U.S. Provisional Patent Application No. 62/307,174 filed on Mar. 11, 2016, the contents of which are incorporated herein by reference.

FIELD OF THE DISCLOSURE

The present disclosure relates to cabinet structure, drawers, and drawer slides. In particular, the disclosure relates to an apparatus for consistently and easily locating the mounting position of a drawer slide such that the drawer slide is square with the cabinet face of a cabinet carcass.

BACKGROUND OF THE DISCLOSURE

Not all cabinets are built perfectly square. As a result, the front face frame is not always perfectly parallel with the rear panel of the cabinet. If the front face and the rear panel are not parallel, problems are created in that drawer slide assemblies mounted to the cabinet carcass tend to be out of alignment. The misalignment of the slides causes them to bind in operation and fail prematurely. These problems are also present for undermount and side mount drawer slide assemblies that incorporate a rear mounted bracket where the drawer slide assembly is only attached to the bracket at the rear and to the cabinet at the face frame. The degree of misalignment is exacerbated by the depth of the cabinet frame.

When a drawer slide assembly is improperly mounted, jamming may result during the movement of the drawer in and out of the cabinet carcass. Additionally, features of the drawer slide assembly such as soft close and push-to-open functionalities may be affected or not function at all. Therefore, it is of utmost importance to ensure that the drawer slide assemblies are mounted square with the cabinet face frame and aligned despite the lack of squareness of the cabinet.

In an effort to overcome these difficulties, the prior has responded with various tools designed to assist the cabinet builder with installation of drawer slide assemblies.

For example, U.S. Pat. No. 8,667,701 to Geesaman discloses a template tool for locating drill holes for mounting brackets and clips of wire shelving. The tool has a first bracket slidable within in a slot of a second bracket. The first bracket fits against the back of the cabinet, the second bracket fits along the inside wall of the cabinet. Holes in the second bracket provide a template for drilling holes in the cabinet to which a drawer slide is attached. The tool is used for locating mounting points on the interior sides of a cabinet carcass instead of the rear panel.

U.S. Pat. No. 7,979,998 to Ziegmann discloses a tool for installing undermount slides in a cabinet. The tool comprises a horizontal and vertical member, each with a top, bottom, front, back, and opposing faces. The vertical member includes a handle and a flat plane. The horizontal member includes a lip offset from the bottom and perpendicular to the flat plane. At least one magnet is attached to the horizontal member. The magnet is used to secure a drawer slide to the tool. The flat plane is positioned adjacent a cabinet face and the tool is clamped to the cabinet. The horizontal member includes a hole pattern that is used to align the mounting holes in the drawer. The tool is used for holding the drawer slide assembly adjacent the side panel of a cabinet while mounting screws are fastened.

U.S. Pat. No. 4,791,732 to Bruno, Jr., et al. discloses an adjustable marking gauge for locating mounting holes of drawer and cabinet hardware. The gauge comprises a rectangular shaped dog slidable along a slide arm. The slide arm includes a 180° bend terminating at a datum surface. Two parallel rods extend perpendicularly from the dog. A rectangular bar is slidably mounted on both stationary arms such that its length is parallel with the length of the body. The rectangular bar further includes equally spaced circular openings. The body is positioned against the side edge of a cabinet door and the datum is positioned adjacent the bottom of the cabinet door. The rectangular bar is positioned adjacent the inside face of the cabinet door. The dog is moved along the slide arm to the desired height. The rectangular bar slides along the stationary rods so that the circular openings can be repeatably positioned to locate mounting holes on the side panel of the cabinet carcass and depends on the side panels to be square with the front panel.

The prior art fails to disclose or suggest an apparatus for consistently and easily locating the mounting position of a rear bracket for a drawer slide. Therefore, there is a need for a tool which can easily and accurately locate the mounting holes for the rear bracket of drawer slide assemblies which compensates for out-of-square cabinet carcasses and thus provides a properly mounted drawer slide assembly such that smooth sliding operation and full use of all drawer slide assembly features are possible.

SUMMARY OF THE DISCLOSURE

In a preferred embodiment, a mounting point locator tool comprises a base slidably mounted on a rod and a bracket holding fixture removably attached to the rod. The base is comprised of a sleeve extending generally perpendicular from a planar plate. The sleeve includes a pair of sides connected at a right angle. The fixture includes a pair of prongs having edges spaced a predetermined distance and a set of slots having a predetermined width.

In use, the fixture is attached to the end of the rod and a bracket is secured to the fixture via the prongs. The plate is secured with clamps or by hand adjacent the front of the face frame of the cabinet carcass such that the sides of the sleeve forming the right angle are positioned in a corner of the drawer opening. The rod is moved through the sleeve until the bracket held by the fixture abuts the rear panel of the cabinet carcass. The bracket is then attached to the rear panel with typical mounting hardware and the fixture is removed from engagement with the bracket. The tool may then be used in an opposite corner should a second bracket be required. Drawer slide assemblies are then mounted on the brackets. Because the sleeve extends from the plate perpendicularly and since the sides of the sleeve form a right angle, the tool corrects for the lack of a square cabinet carcass and ensures that the bracket is positioned properly relative to the face frame.

In an alternate embodiment, the plate, the rod, and the fixture are integrally formed corresponding to a particular sized bracket.

BRIEF DESCRIPTION OF THE DRAWINGS

The disclosed embodiments will be described with reference to the accompanying drawings. Like pieces in different drawings are referenced by the same number.

DETAILED DESCRIPTION

Figure 1:
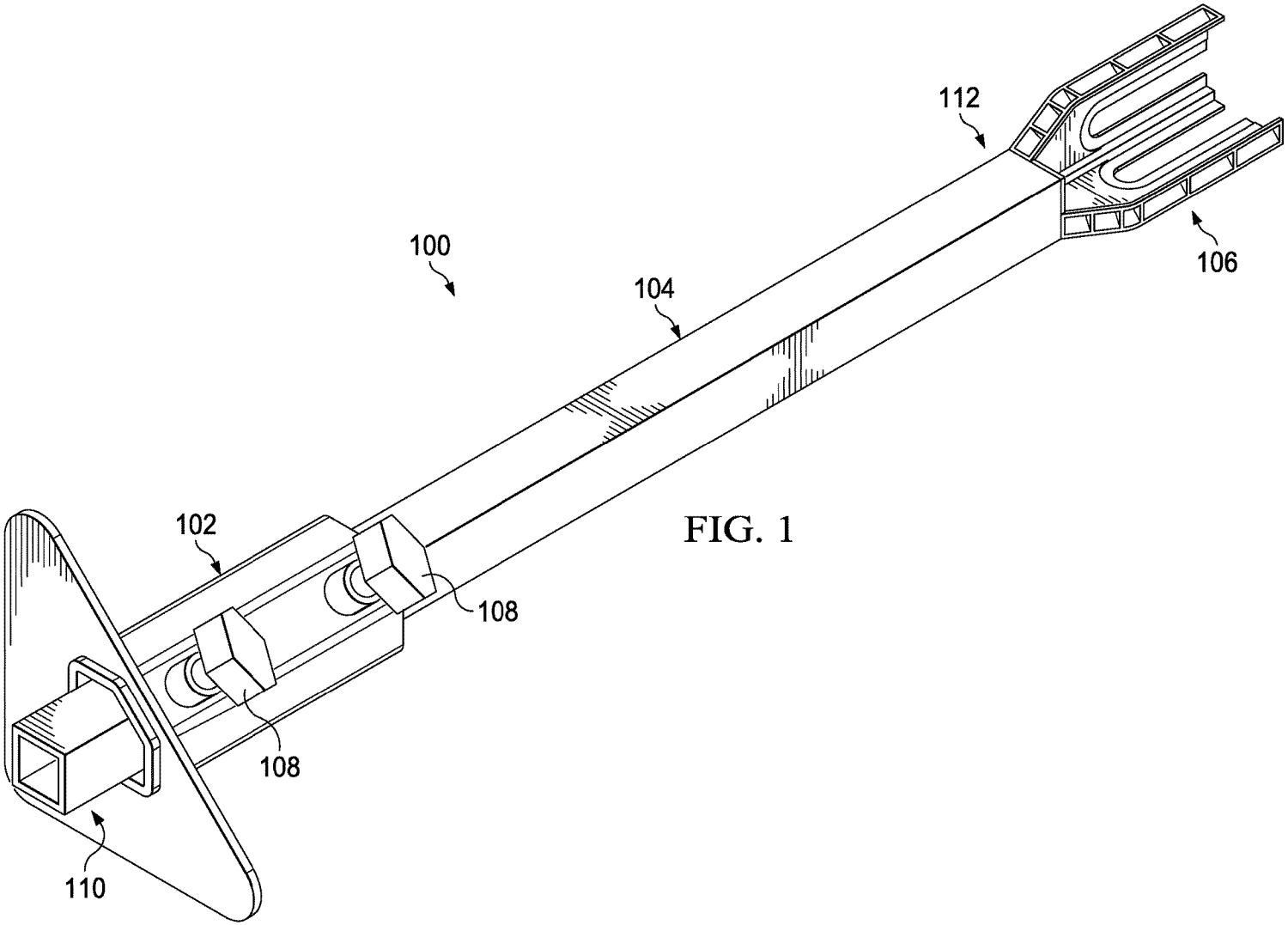
FIG. 1 is an isometric view of a preferred embodiment.

Referring to FIG. 1, locator tool 100 comprises base 102, rod 104, and fixture 106. Base 102 is slidably engaged with rod 104. Rod 104 has ends 110 and 112. Fixture 106 is attached to rod 104 at end 112. Base 102 is slidable along the length of rod 104 between ends 110 and 112. Thumb screws 108 removably secure base 102 to rod 104 at any desired location along the length of rod 104. Locator tool 100 is preferably made of aluminum or stainless steel but can also be formed from injection molded plastic or polyvinyl chloride (PVC).

Figure 2A:
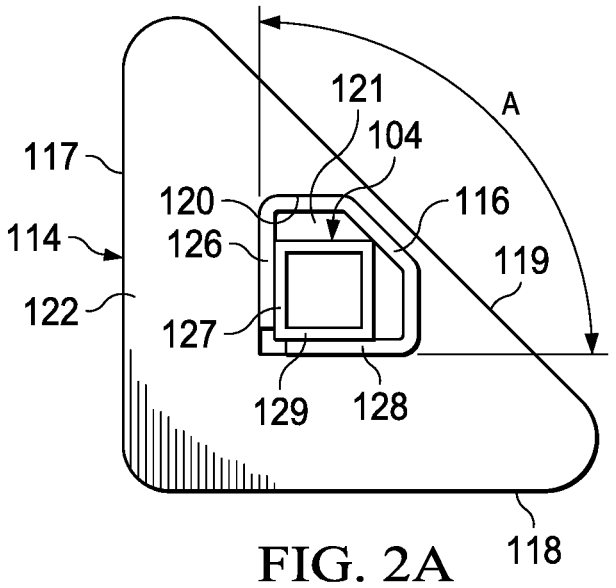
FIG. 2A is an end view of a base of the embodiment of FIG. 1.
Figure 2B:
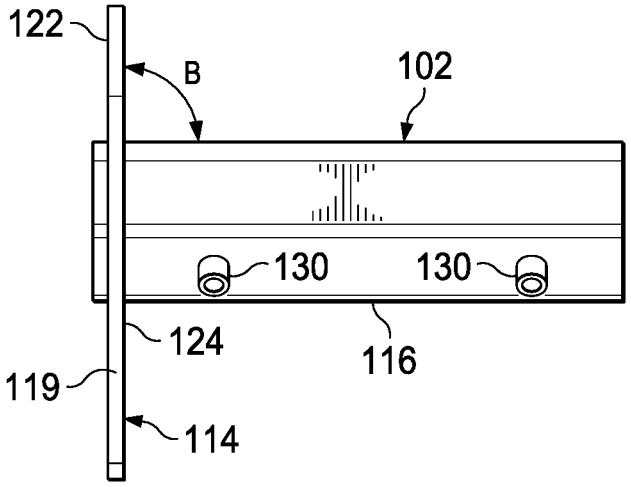
FIG. 2B is a top view of a base of the embodiment of FIG. 1.

As shown in FIGS. 2A and 2B, base 102 comprises plate 114 rigidly attached to sleeve 116. Plate 114 is generally planar having three edges 117, 118, and 119 forming a triangular shape. Plate 114 has opposing faces 122 and 124. Plate 114 includes hole 120 sized to receive sleeve 116.

Sleeve 116 is rigidly affixed to plate 114 in hole 120. Sleeve 116 includes at least side 126 connected to side 128. Angle A between sides 126 and 128 forms a generally 90 degree angle. Sleeve 116 is generally tubular having interior 121. Sleeve 116 has a cross section that mimics the shape of hole 120 and prevents rotation of sleeve 116 within hole 120. Other cross sectional shapes are possible but must include at least one right angle formed by sides 126 and 128. Rod 104 is slidingly received within interior 121. Rod 104 includes at least side 127 connected to side 129 at an angle that matches angle A. Rod 104 is hollow and has a generally square cross section. Other cross sectional shapes would suffice as long as the connection between sides 127 and 129 form angle A. Side 126 abuts side 127 and side 128 abuts side 129 to ensure rod 104 does not rotate with respect to base 102. Sleeve 116 extends from plate 114 perpendicularly at angle B. Angle B forms a generally 90 degree angle. Stanchions 130 extend from sleeve 116 and threadably receive thumb screws 108. Thumb screws 108 can be advanced or retracted through stanchions 130 to abut rod 104 to releasably secure base 102 to rod 104.

Figure 2C:
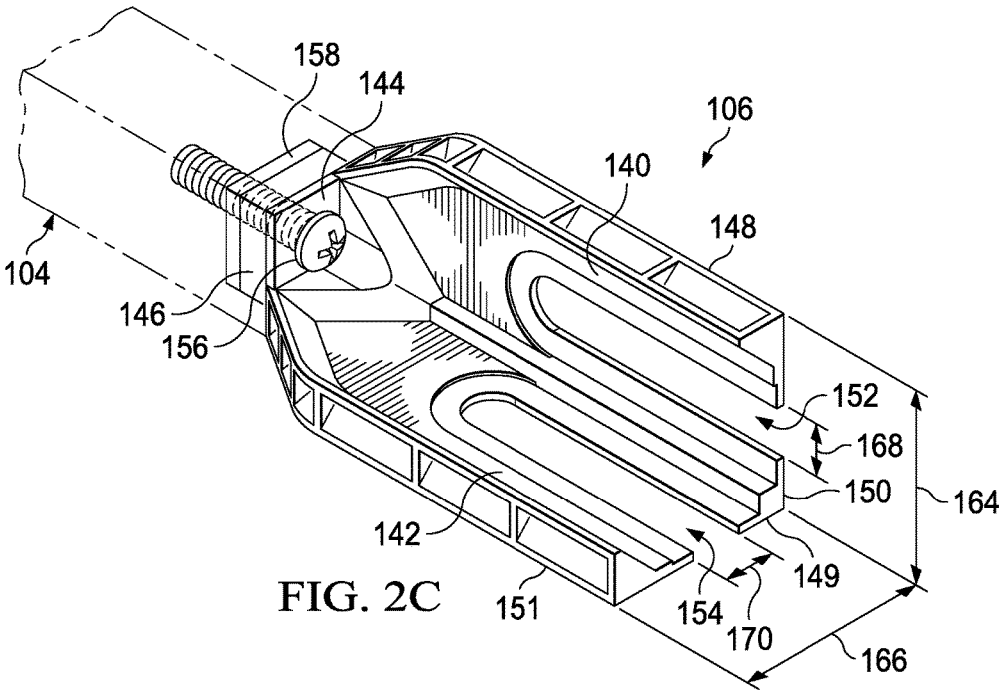
FIG. 2C is an isometric view of a fixture of the embodiment of FIG. 1.
Figure 2D:
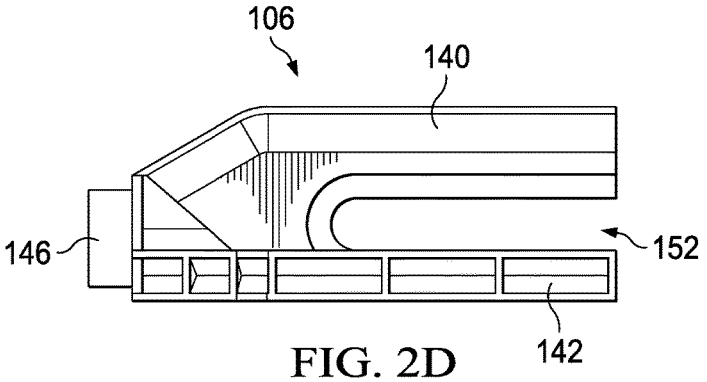
FIG. 2D is a side view of a fixture of the embodiment of FIG. 1.
Figure 2E:
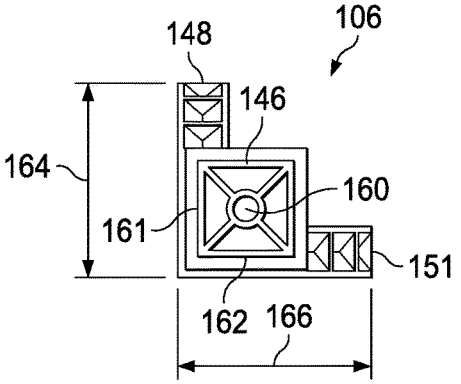
FIG. 2E is an end view of a fixture of the embodiment of FIG. 1.

As shown in FIGS. 2C-2E, fixture 106 comprises prongs 140 and 142, base 144, and insert 146. Prongs 140 and 142 extend generally perpendicularly from base 144. Prong 140 includes open ended slot 152 and prong 142 includes open ended slot 154. Prong 140 has edges 148 and 149 spaced distance 164 apart. Prong 142 has edges 150 and 151 spaced distance 166 apart. Distance 164 and 166 are generally equal in length. Slot 152 has width 168 and slot 154 has width 170. Widths 168 and 170 are generally equal. Distances 164 and 166 combined with widths 168 and 170 are sized to accommodate rear brackets used in the mounting of particular drawer slide assemblies. Fixture 106 is interchangeable and thus may be manufactured with various relative dimensions to accommodate different sized rear brackets for a plurality of drawer slide assemblies.

Insert 146 extends from base 144 opposite prongs 140 and 142. Insert 146 includes at least side 161 connected to side 162 at an angle that matches angle A. Insert 146 has a cross section that matches the cross section of rod 104 such that insert 146 is fit into end 112 of rod 104 without relative motion between the two. Insert 146 includes hole 160. Threaded nut 158 is rigidly affixed to the interior of rod 104 at end 112. Fixture 106 is removeably attached to rod 104 via machine screw 156 sized to pass through hole 160 and threadably engage threaded nut 158. Side 161 abuts side 127 and side 162 abuts side 129. In an alternate embodiment, insert 146 is sized to frictionally fit around the exterior of rod 104 at end 112.

Figure 3A:
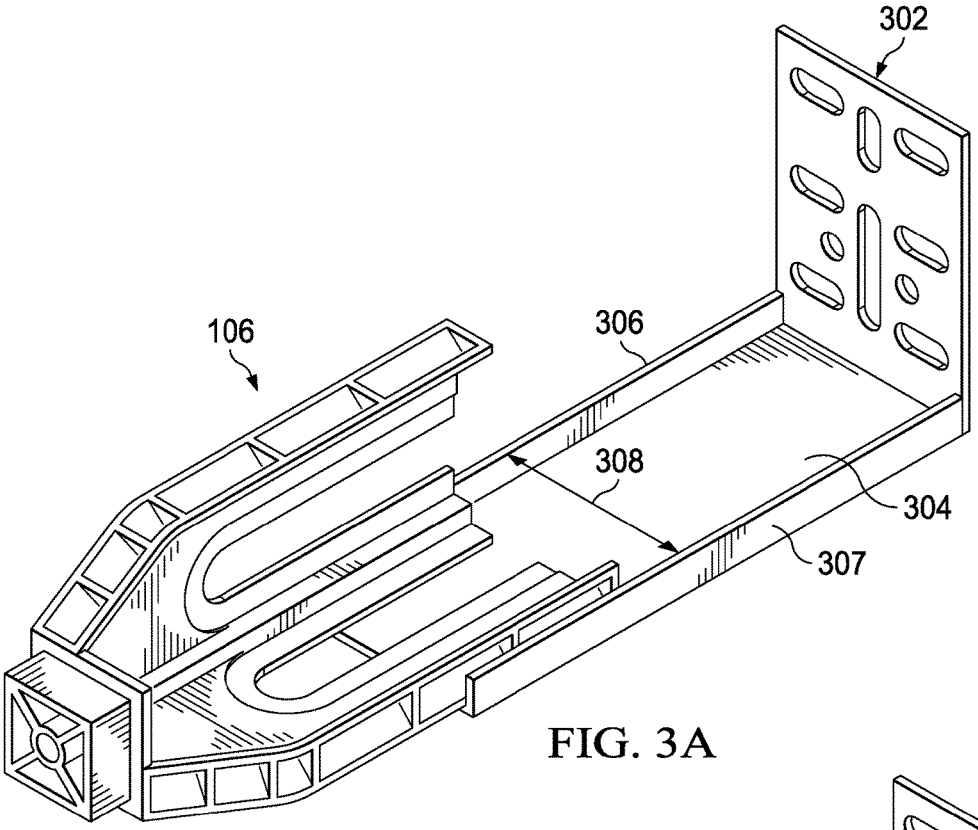
FIG. 3A is an isometric view of a bracket attached to a fixture of the embodiment of FIG. 1.

As shown in FIG. 3A, bracket 302 comprises base 304 having upturned edges 306 and 307. Distance 308 between flanges 306 and 307 is generally equal to distance 166 between edges 150 and 151. Accordingly, bracket 302 can be frictionally and removably attached to fixture 106 by positioning upturned edges 306 and 307 adjacent to edges 150 and 151 or edges 148 and 149. Bracket 302 is typically utilized in the installation of vertically oriented full extension ball bearing drawer slide assemblies.

Figure 3B:
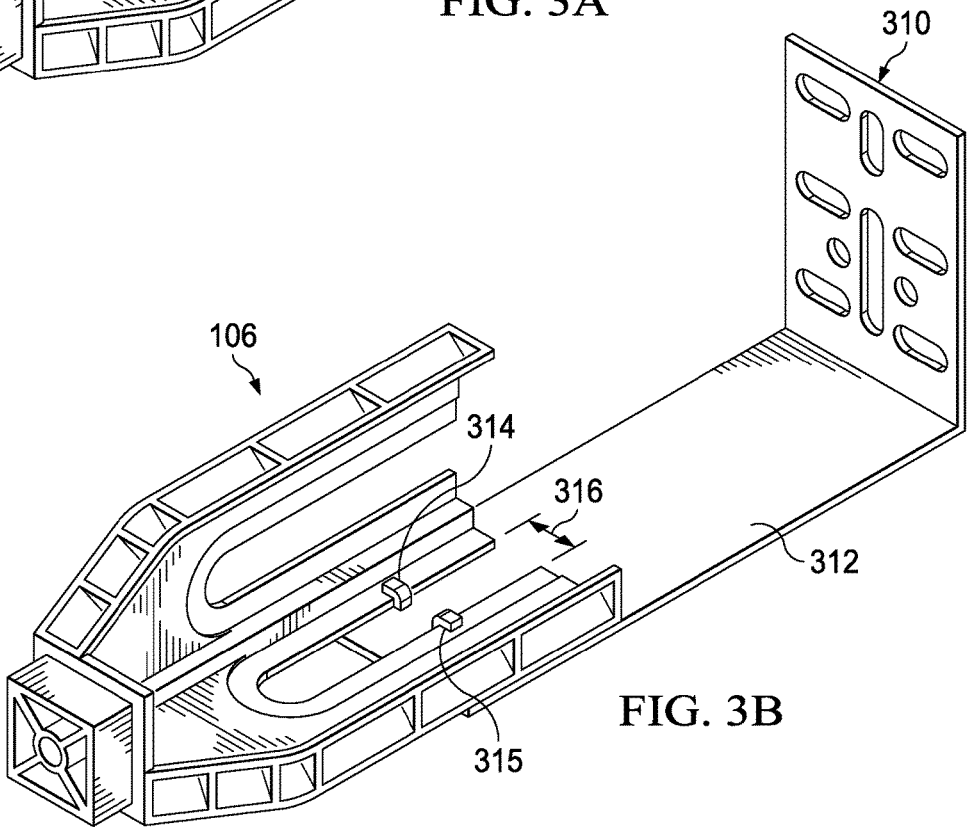
FIG. 3B is an isometric view of a bracket attached to a fixture of the embodiment of FIG. 1.

As shown in FIG. 3B, bracket 310 comprises base 312 having tabs 314 and 315 spaced distance 316 from each other. Distance 316 generally equals width 170 of slot 154. Accordingly, bracket 310 can be frictionally and removably attached to fixture 106 within slot 154 or slot 152 via tabs 314 and 315. Bracket 310 is typically utilized in undermount drawer slide assemblies.

Figure 3C:
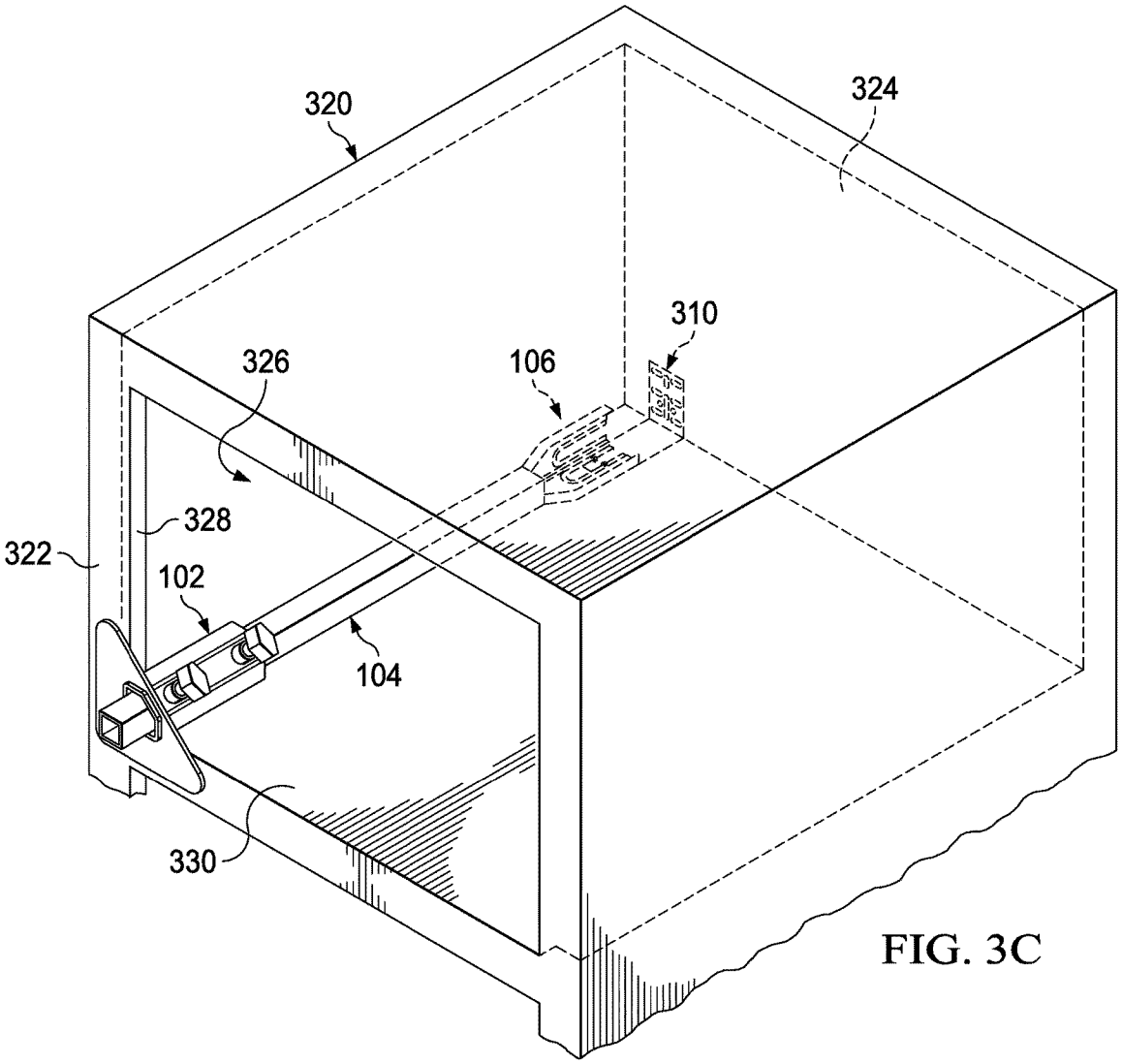
FIG. 3C is an isometric view of the embodiment of FIG. 1 positioned in a cabinet carcass.
Figure 3D:
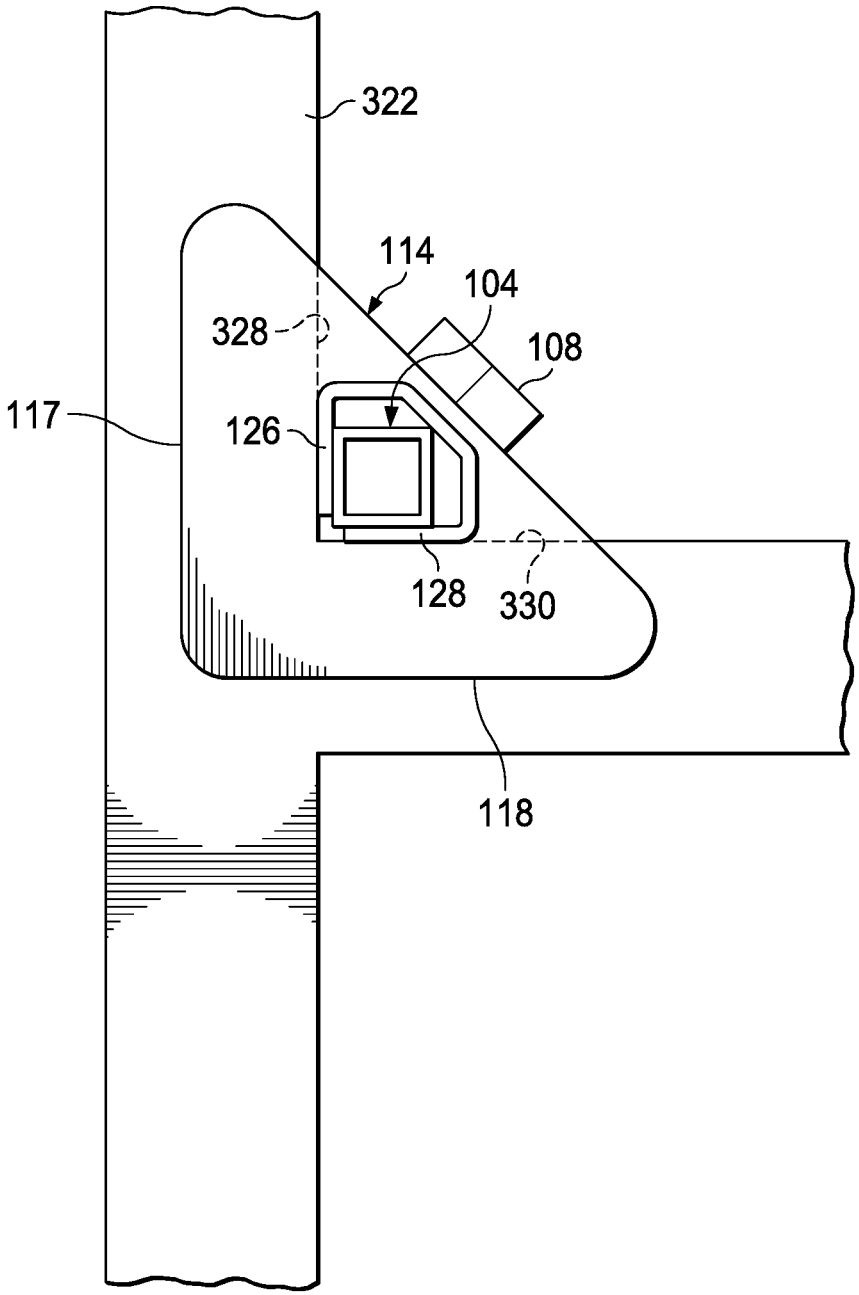
FIG. 3D is a front view of a base of the embodiment of FIG. 1 positioned adjacent a face frame.

As shown in FIGS. 3C and 3D, cabinet carcass 320 includes face frame 322 and rear panel 324. Face frame 322 defines drawer opening 326. Face frame 322 includes face frame edge 328. Cabinet carcass includes drawer opening bottom surface 330 which leads to drawer opening 326.

In use, locator tool 100 is used to easily locate the mounting position of a rear bracket for use with a drawer slide assembly. Locator tool 100 ensures that the drawer slide assembly is properly aligned and thus square with the face frame of a cabinet carcass to ensure smooth movement of the drawer in and out of the cabinet carcass. If multiple drawer slide assemblies are necessary, the locator tool can be rotated and used in the opposite corner of face frame 322 as well. Fixture 106, matched to a desired drawer slide assembly, is removably secured to rod 104 via machine screw 156 through hole 160 and threadably engaged with threaded nut 158. A rear mounting bracket corresponding to fixture 106 and the desired drawer slide assembly is removably affixed to fixture 106. Base 102 is slidingly mounted on rod 104. Face 124 of plate 114 is positioned adjacent to and flush with face frame 322 of cabinet carcass 320. It is important that both edge 117 and edge 118 be simultaneously positioned adjacent face frame 322. Additionally, side 126 is positioned adjacent face frame edge 328 while side 128 is simultaneously positioned adjacent drawer opening bottom surface 330. With face 124 adjacent to face frame 322 and sleeve 116 simultaneously adjacent face frame edge 328 and drawer opening bottom surface 330, base 102 is secured to face frame 322 with hand clamps (not shown). In an alternate embodiment, a handle extends from face 122 for a user to firmly hold base 102 in place. Rod 104 is extended through sleeve 116 until bracket 310 (or any bracket affixed to fixture 106) abuts rear panel 324 of the cabinet carcass. Thumb screws 108 are tightened such that the position of base 102 is fixed relative to rod 104. Bracket 310 is secured to rear panel 324 with typical mounting hardware or suitable adhesive. Base 102 is removed from face frame 322 and fixture 106 is removed from frictional engagement with bracket 310.

As a result, bracket 310 is properly positioned such that the corresponding drawer slide assembly mounted to bracket 310 will be square with the face frame ensuring smooth operation regardless of the "squareness" of the cabinet carcass as a whole.

Figure 4:
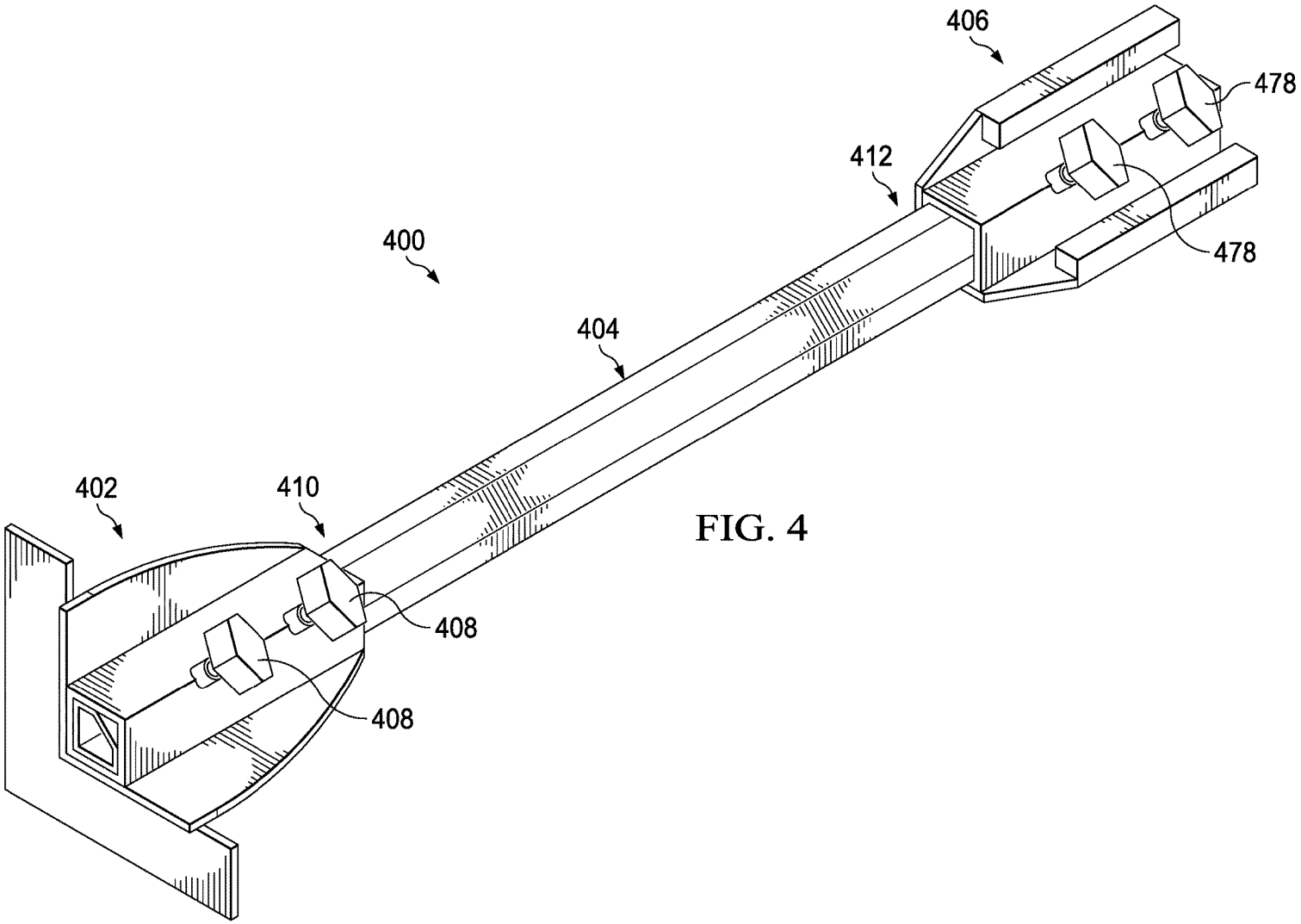
FIG. 4 is an isometric view of an alternate preferred embodiment.

Referring to FIG. 4, locator tool 400 comprises base 402, rod 404, and fixture 406. Base 402 is slidably engaged with rod 404. Rod 404 has ends 410 and 412. Fixture 406 is attached to rod 404 at end 412. Base 402 is slidable along the length of rod 404 between ends 410 and 412. Thumb screws 408 removably secure base 402 to rod 404 at any desired location along the length of rod 404. Locator tool 400 is preferably made of aluminum or stainless steel but could also be formed from injection molded plastic or polyvinyl chloride (PVC).

Figure 5A:
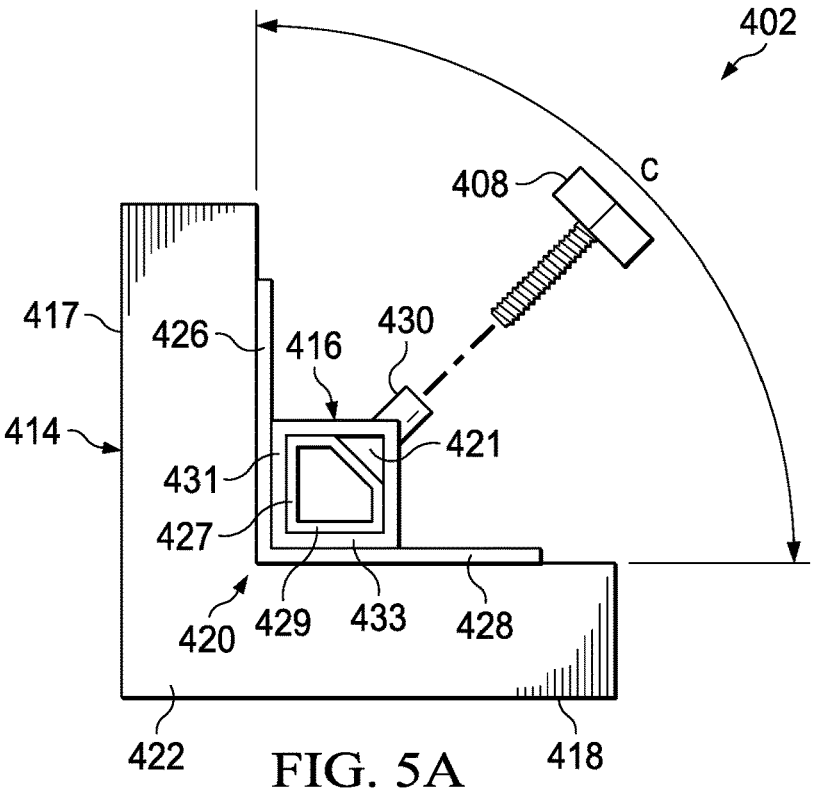
FIG. 5A is an end view of a base of the embodiment of FIG. 4.
Figure 5B:
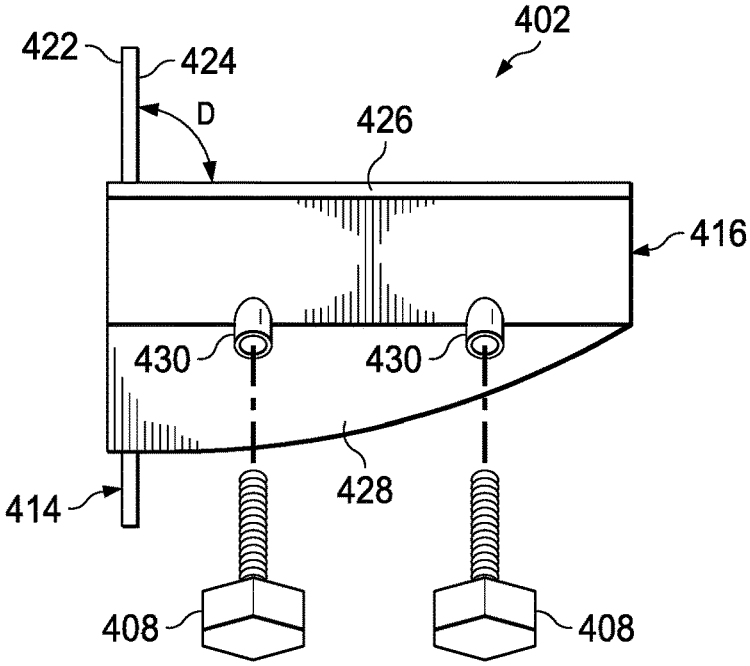
FIG. 5B is a top view of a base of the embodiment of FIG. 4.

As shown in FIGS. 5A and 5B, base 402 comprises plate 414 rigidly attached to sleeve 416. Plate 414 is generally planar having edges 417 and 418 forming an "L" shape having corner 420. Plate 414 has opposing faces 422 and 424.

Sleeve 416 is rigidly affixed to plate 414 at corner 420. Sleeve 416 includes at least flange 426 connected to flange 428. Angle C between flanges 426 and 428 forms a generally 90 degree angle. Sleeve 416 is generally hollow and tubular with a polygonal cross section defining interior 421. Sleeve 416 includes at least side 431 connected to side 433 at an angle that matches angle C. Other cross sectional shapes would suffice. Rod 404 is slidingly received through interior 421. Rod 404 includes at least side 427 connected to side 429 at an angle that matches angle C. Rod 404 may be solid or hollow and has a polygonal cross section. Other cross sectional shapes would suffice. Side 431 abuts side 427 and side 433 abuts side 429 to ensure rod 404 does not rotate with respect to base 402. Sleeve 416 extends from plate 414 perpendicularly at angle D. Angle D forms a generally 90 degree angle. Stanchions 430 extend from sleeve 416 and threadably receive thumb screws 408. Thumb screws 408 can be advanced or retreated through stanchions 430 to abut rod 404 in order to releasably secure base 402 to rod 404.

Figure 5C:
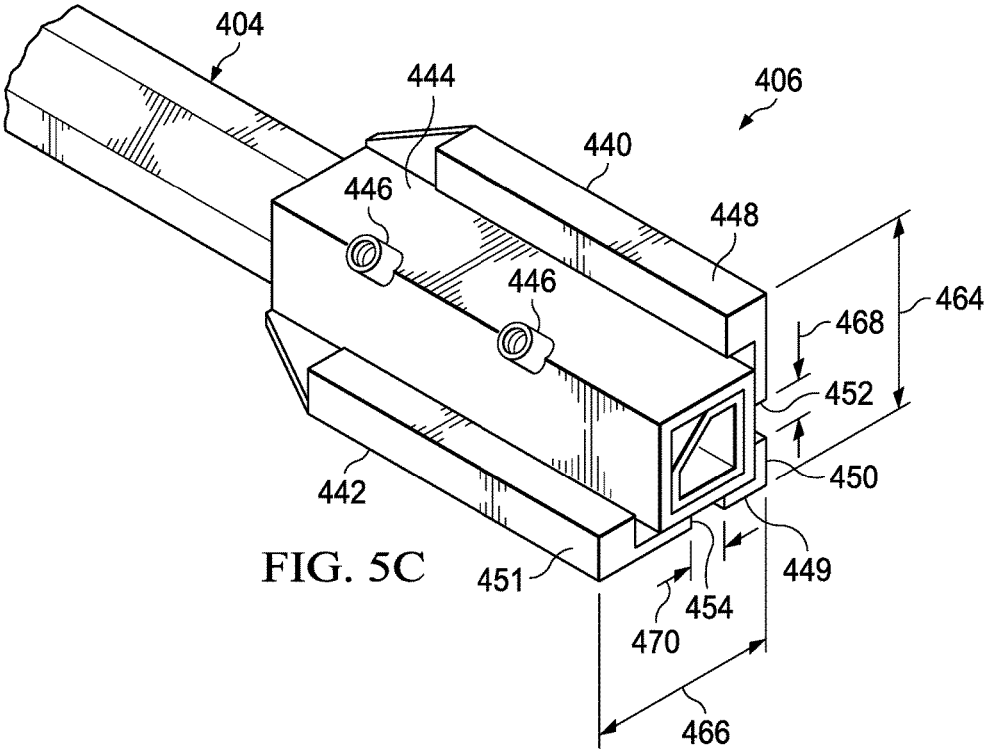
FIG. 5C is an isometric view of a fixture of the embodiment of FIG. 4.
Figure 5D:
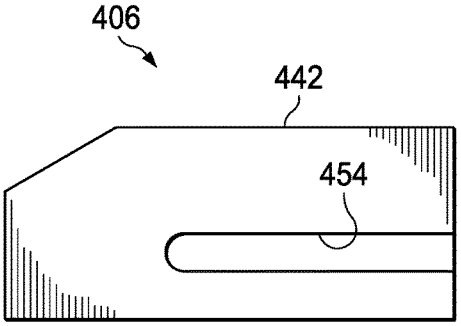
FIG. 5D is a side view of a fixture of the embodiment of FIG. 4.
Figure 5E:
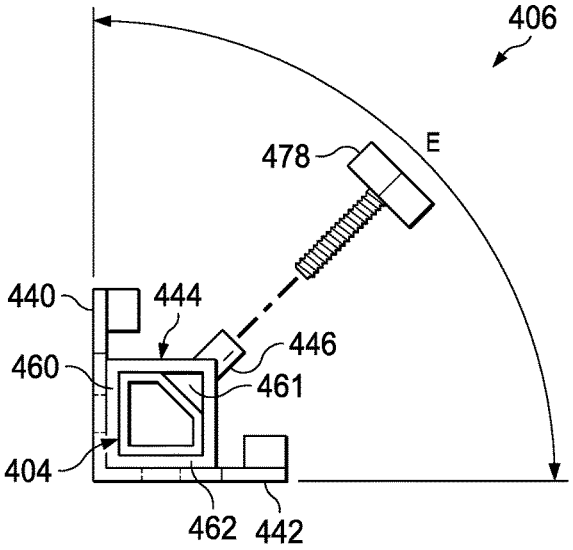
FIG. 5E is an end view of a fixture of the embodiment of FIG. 4.

Referring to FIGS. 5C-5E, fixture 406 comprises prongs 440 and 442 and sleeve 444. Prongs 440 and 442 are connected or integrally formed perpendicular to each other at angle E. Angle E between flanges 426 and 428 forms a generally 90 degree angle. Prong 440 includes open ended slot 452 and prong 442 includes open ended slot 454. Prong 440 has edges 448 and 449 spaced distance 464 apart. Prong 442 has edges 450 and 451 spaced distance 466 apart. Distance 464 and 466 are generally equal in length. Slot 452 has width 468 and slot 454 has width 470. Widths 468 and 470 are generally equal. Distances 464 and 466 combined with widths 468 and 470 are sized to accommodate rear brackets used in the mounting of select drawer slide assemblies. Fixture 406 may be manufactured with relative dimensions to accommodate different sized rear brackets for a plurality of drawer slide assemblies.

Sleeve 444 is rigidly affixed to prongs 440 and 442. Sleeve 444 includes at least side 460 connected to side 462 at an angle that matches angle E. Sleeve 444 is generally hollow and tubular with a polygonal cross section defining interior 461. Other cross sectional shapes would suffice. Rod 404 is slidingly received through interior 461. Stanchions 446 extend from sleeve 444 and threadably receive thumb screws 478. Thumb screws 478 can be advanced or retreated through stanchions 446 to abut rod 404 in order to releasably secure fixture 406 to rod 404.

In use, locator tool 400 locates the mounting points for the rear bracket of a drawer slide assembly to ensure that the drawer slide assembly is square with the face frame of a cabinet carcass. Fixture 406, matched to a desired drawer slide assembly, is removably secured to rod 404 via thumb screws 478 through stanchions 446. A rear mounting bracket corresponding to fixture 406 and the desired drawer slide assembly is removably affixed to fixture 406. As described in previous embodiments, bracket 302 can be frictionally and removably secured to fixture 406 by positioning upturned edges 306 and 307 adjacent to edges 448 and 449 or adjacent to edges 450 and 451. Similarly, bracket 310 can be frictionally and removably attached to fixture 406 within slot 452 or slot 454 via tabs 314 and 315.

Base 402 is slidingly mounted on rod 404 with rod 404 positioned in interior 421. Face 424 is positioned adjacent to and flush with face frame 322 of cabinet carcass 320. It is important that both edges 417 and 418 be simultaneously held adjacent face frame 322. Additionally, flange 426 is positioned adjacent face frame edge 328 while flange 428 is simultaneously positioned adjacent drawer opening bottom surface 330. With face 424 adjacent to face frame 322, flange 426 adjacent face frame edge 328, and flange 428 adjacent drawer opening bottom surface 330, base 402 is secured to face frame 322 with hand clamps (not shown) such that the position of base 402 is fixed relative to face frame 322. In an alternate embodiment, a handle extends from face 422 for a user to firmly hold base 402 in place. Rod 404 is extended through sleeve 416 until the bracket affixed to fixture 406 abuts rear panel 324 of the cabinet carcass. Thumb screws 408 are tightened such that the position of base 402 is fixed relative to rod 404. The bracket is secured to rear panel 324 with typical mounting hardware or suitable adhesive. Base 402 is detached from face frame 322 and fixture 406 is removed from frictional engagement with the bracket. If multiple drawer slide assemblies are necessary, the locator tool can be rotated and used in the opposite corner of face frame 322 as well.

Figure 6A:
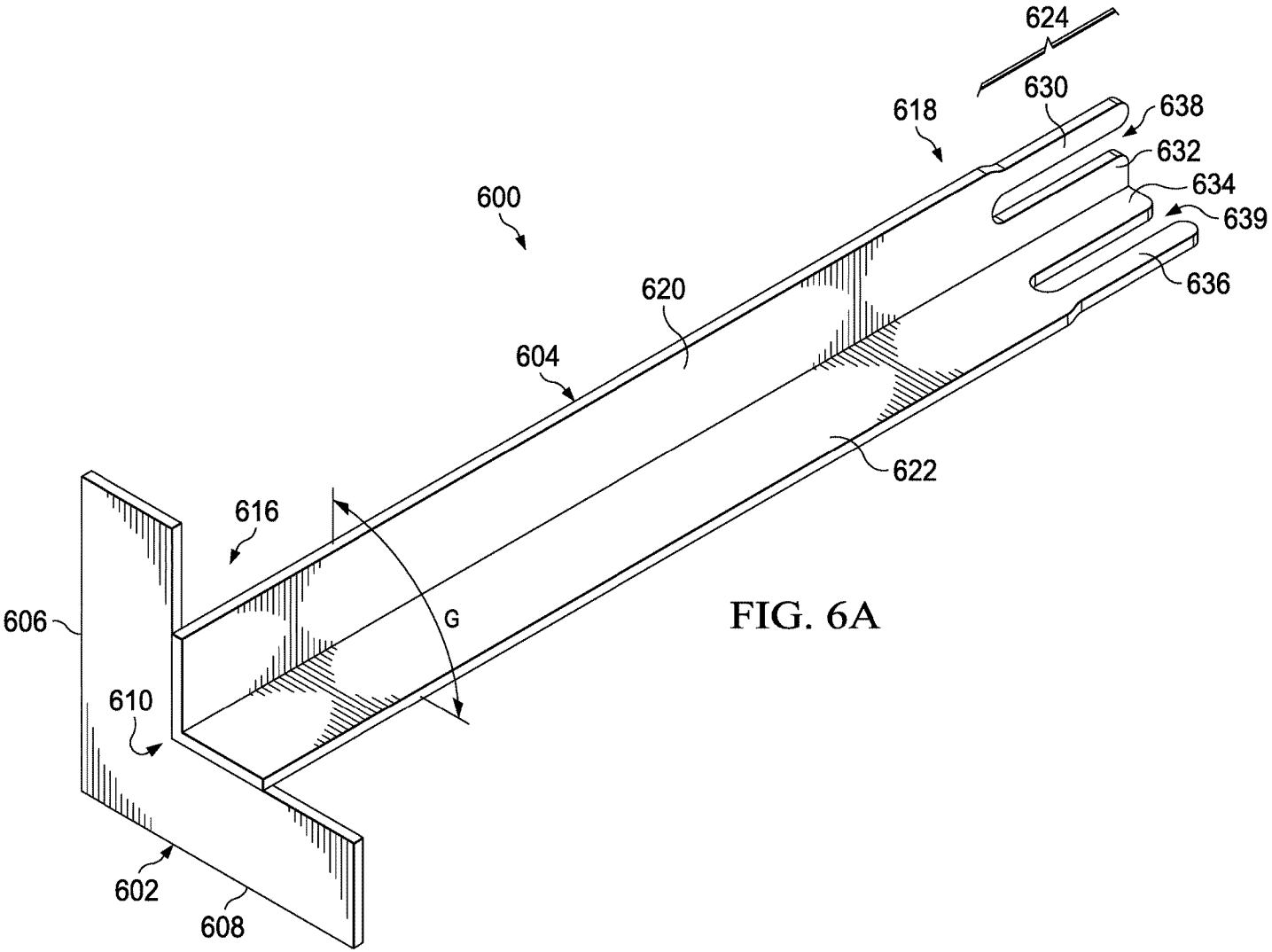
FIG. 6A is an isometric view of an alternate preferred embodiment.
Figure 6B:
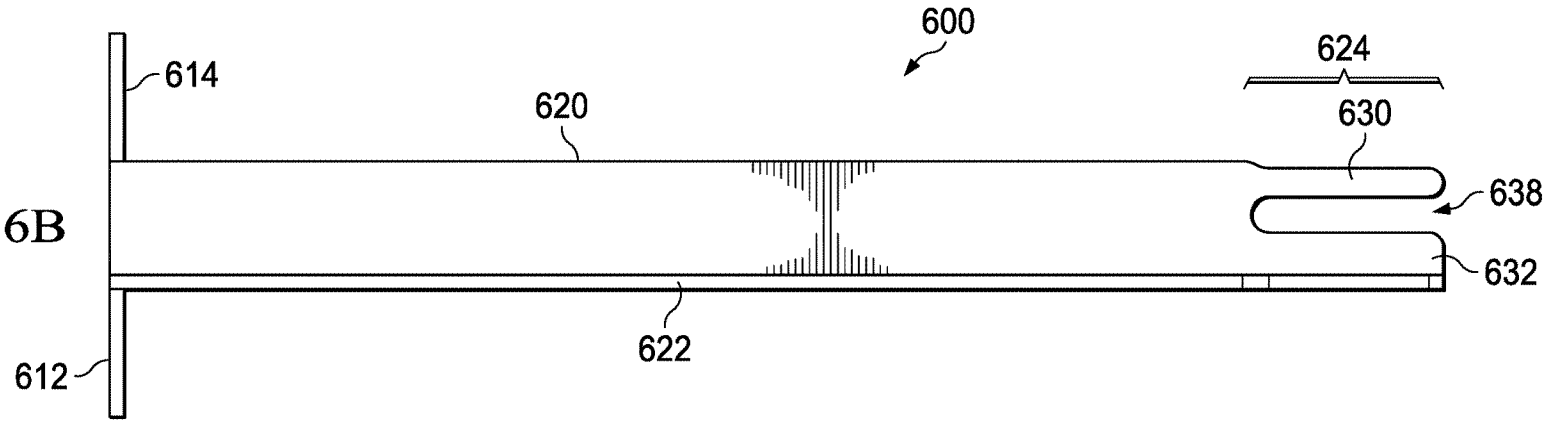
FIG. 6B is a top view of the embodiment of FIG. 6A.
Figure 6C:
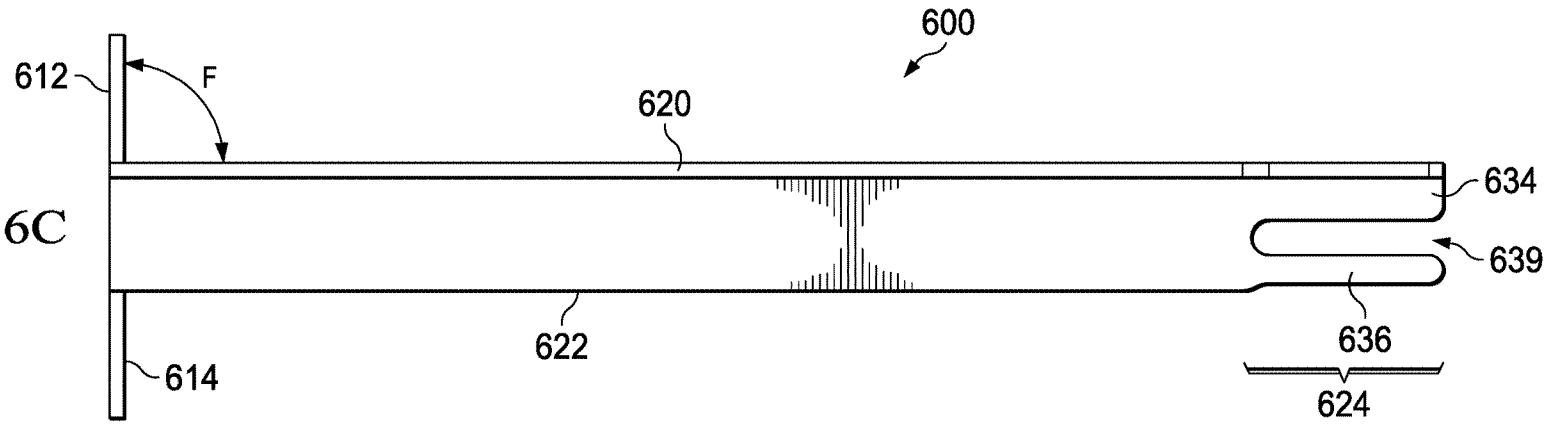
FIG. 6C is a side view of the embodiment of FIG. 6A.

Referring to FIGS. 6A-C, locator tool 600 comprises base 602 and shaft 604. Based on the length of shaft 604, locator tool 600 is manufactured to correspond to a cabinet carcass having a particular depth. Shaft 604 may be manufactured at different lengths corresponding to different sized cabinets. Locator tool 600 is preferably made of aluminum or stainless steel but could also be formed from injection molded plastic such as polyvinyl chloride (PVC).

Base 602 is generally planar having edges 606 and 608 forming an "L" shape having corner 610. Base 602 has opposing faces 612 and 614. Shaft 604 is rigidly affixed to base 602 at corner 610. Shaft 604 extends from base 602 perpendicularly at angle F. Angle F forms a generally 90 degree angle.

Shaft 604 has a generally "L" shaped cross section and includes flange 620 connected to flange 622. Angle G between flanges 620 and 622 forms a generally 90 degree angle. Shaft 604 has ends 616 and 618. Shaft 604 is rigidly connected to base 602 at end 616. Shaft 604 forms fixture 624 at end 618.

Fixture 624 comprises a plurality of prongs and slots formed in flanges 620 and 622 at end 618. Flange 620 includes prong 630 and prong 632 separated by open ended slot 638. Flange 622 includes prong 634 and prong 636 separated by open ended slot 639.

In use, a rear bracket is removably engaged with fixture 624. As previously described, upturned edges of the bracket frictionally engage the edges of prongs 630 and 632 or the edges of prongs 634 and 636. Alternatively, tabs extending from the bracket by frictionally engage slot 638 or slot 639. Base 602 is positioned adjacent a face frame of a cabinet such that face 614 is flush with the front of the face frame. Flange 620 is positioned adjacent the face frame edge and flange 622 is positioned adjacent the drawer opening bottom surface. It is important that both edges 606 and 608 are simultaneously held adjacent the face frame while flanges 620 and 622 are adjacent the face frame edge and the drawer opening bottom surface, respectively. Base 602 is secured to the face frame with hand clamps.

The bracket is secured to rear panel of the cabinet carcass with typical mounting hardware or suitable adhesive. Base 602 is detached from the face frame and fixture 624 is removed from frictional engagement with the bracket. If multiple drawer slide assemblies are necessary, the locator tool can be rotated and used in the opposite corner of the face frame.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A mounting point locator tool for positioning a bracket of a drawer slide in a cabinet carcass comprising:

a generally planar plate;

a shaft, including a first edge generally perpendicular to a second edge, extending generally perpendicular from the plate; and, a set of prongs connected to the shaft;

the set of prongs, configured to releasably secure and position the bracket to the cabinet carcass.

2. The mounting point locator tool of claim 1 further comprising a fixture, connected to the shaft, where the fixture comprises:

at least one slot, defined by the set of prongs.

3. The mounting point locator tool of claim 2 wherein the fixture is releasably connected to the shaft.

4. The mounting point locator tool of claim 2 wherein the fixture further comprises:

a first prong of the set of prongs defining a set of edges, where the set of edges are configured to frictionally and releasably engage the bracket.

5. The mounting point locator tool of claim 2 wherein the fixture further comprises:

a first prong of the set of prongs defining a slot, where the slot is configured to frictionally and releasably engage the bracket.

6. The mounting point locator tool of claim 2 wherein the fixture further comprises:

a first prong of the set of prongs defining a first set of edges, where the first set of edges are spaced a distance from each other and are configured to frictionally and releasably engage the bracket;

a second prong of the set of prongs defining a second set of edges, where the second set of edges are spaced the distance from each other.

7. The mounting point locator tool of claim 2 wherein the fixture further comprises:

a first prong of the set of prongs defining a first slot, where the first slot has a width and is configured to frictionally and releasably engage the bracket; and, a second prong of the set of prongs defining a second slot, where the second slot has the width.

8. The mounting point locator tool of claim 2 wherein the fixture further comprises:

a generally tubular sleeve, including a first side generally perpendicular to a second side, connected to the set of prongs and slidingly engaged with the shaft where the first side is adjacent the first edge and the second side is adjacent the second edge.

9. The mounting point locator tool of claim 1 further comprising:

a generally tubular sleeve, including a first side generally perpendicular to a second side, connected to the plate and slidingly engaged with the shaft where the first side is adjacent the first edge and the second side is adjacent the second edge.

10. The mounting point locator tool of claim 1 further comprising:

a generally tubular sleeve connected to the plate and slidingly engaged with the shaft; and, set of screws threadably engaged with the sleeve and configured to releasably secure the sleeve to the shaft.

11. A apparatus for locating the mounting position of a bracket of a drawer slide assembly such that the drawer slide assembly is square with a face frame of a cabinet carcass comprising:

a plate configured to be adjacent the face frame;

a generally tubular sleeve, including a first side perpendicularly connected to a second side, rigidly connected to the plate at a right angle;

a rod, including a first edge generally perpendicular to a second edge, slidingly engaged with the sleeve, where the first edge is adjacent the first side and the second edge is adjacent the second side; and, a fixture connected to the rod and configured to releasably engage the bracket.

12. The apparatus of claim 11 wherein the fixture further comprises:

an insert, including a first section perpendicularly connected to a second section, releasably engaged with the rod where the first section abuts the first edge and the second section abuts the second edge;

a first prong and a second prong extending from the insert and where the first prong is connected to the second prong at a generally right angle.

13. The apparatus of claim 11 wherein the fixture further comprises:

a first prong connected to a second prong at a generally right angle;

the first prong defining a first set of edges, where the first set of edges are spaced a distance from each other and are configured to frictionally engage the bracket;

the second prong defining a second set of edges, where the second set of edges are spaced the distance from each other.

14. The apparatus of claim 11 wherein the fixture further comprises:

a first prong connected to a second prong at a generally right angle;

the first prong defining a first slot, where the first slot has a width and is configured to frictionally engage the bracket; and, the second prong defining a second slot, where the second slot has the width.

15. The apparatus of claim 11 wherein the fixture further comprises:

a first prong connected to a second prong at a generally right angle; and, a generally tubular coupling, including a first side generally perpendicular to a second side, connected to the first prong and the second prong and slidingly engaged with the rod where the first side is adjacent the first edge and the second side is adjacent the second edge.

16. A method for mounting a bracket of a drawer slide assembly such that the drawer slide assembly is square with a face frame of a cabinet carcass comprising:

providing a base plate connected perpendicularly to a shaft, where the shaft has a cross section including a right angle;

providing a set of prongs connected to the shaft and configured to releasably engage the bracket;

attaching the bracket to the set of prongs;

positioning the base plate adjacent a front of the face frame;

positioning the right angle of the shaft adjacent a corner of the face frame;

abutting the cabinet carcass with the bracket;

securing the bracket to the cabinet carcass; and, disengaging the fixture from the bracket.

17. The method for mounting a bracket of claim 16 further comprising:

securing the base plate to the face frame with hand clamps.

18. The method for mounting a bracket of claim 16 further comprising:

removing the base plate from the face frame.

19. A method for mounting a bracket of a drawer slide assembly such that the drawer slide assembly is square with a face frame of a cabinet carcass comprising:

providing a base plate connected perpendicularly to a shaft, where the shaft has a cross section including a right angle;

providing a fixture connected to the shaft and configured to releasably engage the bracket;

attaching the bracket to the fixture;

positioning the base plate adjacent a front of the face frame;

positioning the right angle of the shaft adjacent a corner of the face frame;

abutting the cabinet carcass with the bracket;

securing the bracket to the cabinet carcass;

disengaging the fixture from the bracket;

extending the shaft through the base plate; and, securing the base plate to the shaft.

* * * * *